United States Patent [19]

Terakawa et al.

[11] Patent Number: 5,053,582

[45] Date of Patent: Oct. 1, 1991

[54] ELECTROMAGNETIC WAVES SHIELD TAPE

[75] Inventors: Takashige Terakawa; Wataru Kusakabe; Yoshihisa Hiraoka, all of Kanagawa; Toshihisa Sugiyama, Tokyo, all of Japan

[73] Assignee: Tokyo Keiki Co., Ltd., Tokyo, Japan

[21] Appl. No.: 528,506

[22] Filed: May 25, 1990

[30] Foreign Application Priority Data

May 26, 1989 [JP] Japan ..... 1-61126[U]

[51] Int. Cl.[5] ..... H01B 7/34

[52] U.S. Cl. ..... 174/36; 156/53; 174/108; 174/109

[58] Field of Search ..... 174/36, 108, 109, 117 A; 428/463, 192, 347, 349; 156/52, 53

[56] References Cited

U.S. PATENT DOCUMENTS

| | | | |
|---|---|---|---|
| 3,032,604 | 5/1962 | Timmons | 174/36 |
| 3,312,775 | 4/1967 | Lambert | 156/53 X |
| 3,325,589 | 7/1967 | Mildner | 174/36 |
| 3,474,186 | 10/1969 | Hale | 174/109 |
| 4,327,246 | 4/1982 | Kincaid | 174/36 |
| 4,719,320 | 1/1988 | Strait, Jr. | 174/108 X |
| 4,731,500 | 3/1988 | Otsuka | 174/36 |
| 4,855,534 | 8/1989 | O'Connor | 174/36 |

FOREIGN PATENT DOCUMENTS

| | | | |
|---|---|---|---|
| 5483 | 1/1977 | Japan | 174/109 |
| 2130430 | 5/1984 | United Kingdom | 174/36 |

*Primary Examiner*—Morris H. Nimmo
*Attorney, Agent, or Firm*—Sughrue, Mion, Zinn, Macpeak & Seas

[57] ABSTRACT

A magnetic wave shield tape comprises a strip-shaped conductive member and a strip-shaped insulative member, the strip-shaped magnetic member being fixed to and overlapping the strip-shaped insulative member in the width direction.

3 Claims, 1 Drawing Sheet

ELECTROMAGNETIC WAVES SHIELD TAPE

BACKGROUND OF THE INVENTION

The present invention relates to a shield tape which electromagnetically shields an electric wire or cable to be used for connection of an electric appliance or between electric appliances.

In a conventional manner, a strip-shaped conductive mesh material or metal foil is wound on an outer coating of an electric wire, cable or power source line (hereinafter simply referred to as an "electric wire") in order to remove or suppress noisy electromagnetic waves induced by the electric wires and to remove or suppress an undesirable electromagnetic energy induction or radiation such as unnecessary electromagnetic wave radiation and the like generated due to the connection of the electric wires or the electric wire.

Further, an insulative tape such as a vinyl tape and the like is wound on the surface of the mesh material or metal foil. Through these steps, the conductive mesh material is fixed to the outer coating of an electric wire. In addition, an undesired short circuit is prevented and an outer aesthetic finish results.

It is, however, necessary for the prior art to provide two manufacturing steps, of forming the EM shield tape that is, a step of winding a conductive member made of a conductive mesh material or a metal foil on the outer coating of the electric wire and a step of winding the insulative tape on the conductive member.

When the conductive member is wound on an outer coating of the electric wire, case must be taken in order to avoid loosening of the conductive member and any gap therebetween. Therefore, at the beginning or the end of winding the conductive member thereon, the conductive member is pressed by a hand or tied with a string to fix it temporarily on the outer coating. Further, the vinyl tape is sealed on the conductive member so that the conductive member is fixed on it.

Therefore, there are serious defects in that these steps are troublesome and production costs are increased.

SUMMARY OF THE INVENTION

Accordingly, an object of the present invention is to provide an electromagnetic shield tape which needs only one easy production step for winding and can shield without making any gap between the conductive member and the electric wire. Further, waterproofing and preventing a short circuit can be obtained.

In order to attain these and other objects, the present invention provides an electromagnetic wave shield tape comprising a strip-shaped conductive member and a strip-shaped insulative member. The conductive member and the insulative member are fixed to partially overlap with each other in a widthwise or transverse direction.

Further, with this shield tape, it is possible to provide an adhesive material to an inner surface of an offset portion of the insulative member, that is, the surface of the insulative member facing the conductive member.

As described above, according to the present invention, it is sufficient to carry out one winding step, that is, a step of winding the shield tape in the oblique or helical direction to the electric wire. In addition, shielding of electromagnetic waves, preventing a short circuit and waterproofing can be obtained.

In other words, the strip-shaped conductive member is spirally or helically wound on the outer coating of the electric wire so as to contact the surface of the conductive member with the coating. With respect to the electromagnetic wave shield tape, the strip-shaped conductive member and the strip-shaped insulative member are provided so as to partially overlap with each other in the widthwise direction. Therefore, the offset portion of the conductive member in the shield tape which has been just wound through one turn is always overlapped with an inner surface of the conductive member which will be wound in the next turn so that the shield tape is wound to keep an electric connection. Therefore, the outer coating of the electric wire is wholly covered with the conductive member which provides an electromagnetic shielding function without any electrical damage.

When an adhesive material is provided to the offset surface of the insulative member on the side facing the conductive member, the side surface of the insulative member is overlapped with the outer surface of the shield tape which has been just wound through one turn. The shield tape can be wound to be fixed to the electric wire by the adhesive material. Further, the entire outer surface provided by the shield tape can be completely covered with the insulative member. In addition, due to the adhesive material, a portion of the insulative member is completely shielded with the adjacent portion of the insulative member, thereby preventing a short circuit and allowing waterproofing of the structure.

With respect to an end portion of the shield tape, an offset portion of the conductive member is exposed without being covered with the insulative member. A ground wire can be connected to this end portion and grounded by soldering.

DETAILED DESCRIPTION OF THE PREFERRED EMBODIMENT

The present invention will now be described with reference to the accompanying drawings.

Figure 1:
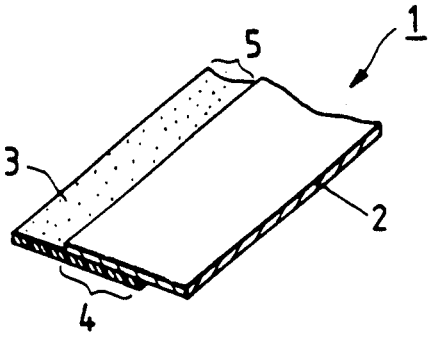
FIG. 1 is a perspective view showing a part of an electromagnetic wave shield tape according to an embodiment of the present invention.

FIG. 1 is a perspective view showing a part of an electromagnetic wave shield tape 1 according to the present invention.

A strip-shaped conductive member 2 and a strip-shaped insulative member 3 are fixed to each other so as to partially overlap in the widthwise or transverse direction. The strip-shaped conductive member 2 is made of conductive material. The conductive member 2 imparts an electromagnetic wave shield effect to the electric wire which has the conductive member 2 wound therearound. A mesh made of a metal wire or a metal tape made of copper or the like may be used as a material for the conductive member 2.

The strip-shaped insulative member 3 is made of an insulative material. The insulative member 3 prevents a short circuit between the electric wires and allows for waterproofing of the structure. Generally, a vinyl chloride is used for the insulative member 3.

An overlapped portion 4 is formed by overlapping the conductive member 2 on the insulative member 3. In other words, the conductive member 2 is partially fixed to the insulative member 3 by an adhesive or a heat seal. An adhesive material is provided to a surface of a offset portion 5 of the insulative member 3 which is offset from the conductive member 2 on the side facing the conductive member 2.

A process of forming the electromagnetic wave shield tape 1 of the present invention is as follows.

Figure 2:
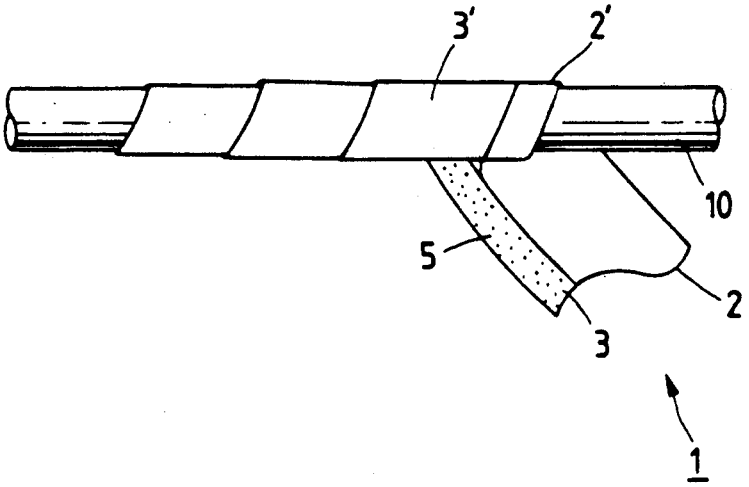
FIG. 2 is a perspective view showing a primary part of the electromagnetic wave shield tape according to the embodiment shown by FIG. 1.

FIG. 2 is a perspective view showing a process of winding the shield tape on the outer coating of the electric wire.

As shown in FIG. 2, the conductive member 2 of the shield tape 1 is spirally or helically wound on an outer coating of the electric wire so as to contact the conductive member 2 with the coating and to overlap partially the shield tape 1 which has been just wound through one turn. The conductive member 2 and the insulative member 3 have an offset portion 2' of the conductive member 2 and an offset portion 5 of the insulative member 3 with respect to each other in the widthwise direction. Therefore, with respect to the shield tape 1 which has been just wound through one turn, the offset portion 2' projects in the winding direction and an inner surface of the conductive member 2 of the shield tape 1 which will be wound in the next turn is overlapped on the offset portion 2'. Accordingly, the conductive member 2 keeps an electric contact over all the circumference so that an excellent electromagnetic wave shield effect can be obtained. Further, an adhesive material is provided to the surface of the offset portion 5 of the insulative member 3 which is offset in the widthwise direction and is facing the conductive member 2. Therefore, the surface of the offset portion 5 can adhere to the shield tape 1 which has been just wound through one turn and the shield tape 1 is fixed to the electric wire 10 by such a simple winding process.

With respect to the end portion of winding, the offset portion 2' of the conductive member 2 is exposed without being covered with the shield tape 1. However, since the end portion can be connected to the ground by soldering, the electric wire 10 can be completely shielded.

Except for the end portion of the winding, all entire outer surface of the electric wire 10 is covered with insulative member 3. Therefore, preventing a short circuit can be easily accomplished. In addition, since the insulative member 3 can be tightly adhered to each other by the adhesive material provided to the insulative member 3, waterproofing of the structure results therefrom.

When a ground wire should be connected to a center portion of the electric wire 10, it is preferable that the shield tape 1 is wound from the center portion to end portions of the electric wire 10. In this case, the offset portion 2' of the conductive member 2 is exposed at the center portion of the electric wire 10. Therefore, the ground wire can be connected to this portion and grounded by soldering.

It is convenient that various types of signals sent through the electric wire can be distinguished from each other by providing various colors such as red, yellow and the like, on the insulative members 3.

As described above, according to the electromagnetic wave shield tape according to the present invention, the conductive member 2 and the insulative member 3 are fixed to each other to partially overlap one another in the widthwise direction so that the conductive member 2 can be wound to keep an electric contact. In addition, since the adhesive material is provided to the offset surface 5 of the insulative member 3, the shield tape 1 can be wound to fix to the outer coating of the electric wire 10.

Therefore, the shielding electromagnetic waves, preventing a short circuit and can be obtained by the a single easy winding step. Further, efficiency can be increased and manufacturing cost can be reduced.

What is claimed is:

1. An electric wire shielded with an electromagnetic wave shield tape comprising:

an electric wire;

a strip-shaped conductive member and a strip-shaped insulative member, said conductive member being fixed to said insulative member so as to partially overlap said insulative member in a widthwise direction, wherein said insulative member is offset from said conductive member to define an offset portion on said insulative member, and wherein an adhesive material is applied at least to said offset portion; wherein said electromagnetic shield tape being wound helically on an outer surface of said electric wire so that said adhesive material applied to said offset portion adheres to said electric wire during a first winding turn of said tape being wound on said electric wire and so that a successive winding turn of said shield tape partially overlaps a winding turn of said shield tape just wound.

2. A method of shielding an electric wire with an electromagnetic wave shield structure having a strip-shaped conductive member and a strip-shaped insulative member, comprising the steps of:

providing an electric wire;

fixing said insulative member to said conductive member so that said insulative member partially overlaps said conductive member in the widthwise direction to thereby form an electromagnetic wave shield tape;

providing an adhesive material on a surface of an offset portion where said insulative member is offset from said conductive member; and winding helically said electromagnetic shield tape on an outer surface of said electric wire so that said adhesive material applied to said offset portion adheres to said electric wire during a first turn of winding said tape on said electric wire and a successive winding turn of said shield tape partially overlaps a winding turn of said shield tape just wound.

3. A method for shielding an electric wire from a noisy electromagnetic wave or an undesirable electromagnetic energy induction or radiation, comprising the steps of:

providing an electric wire, a strip-shaped insulative member and a strip-shaped conductive member;

fixing said insulative member to said conductive member so that said insulative member partially overlaps said conductive member in the widthwise direction to thereby form an electromagnetic wave shield tape;

providing an adhesive material on a surface of an offset portion of said insulative member where said insulative member is offset from said conductive member and not overlapped thereby when said insulative member is fixed to said conductive member; and winding helically said electromagnetic wave shield tape on an outer surface of said electric wire so that said adhesive material applied to said offset portion adheres to said electric wire during a first turn of winding said tape on said electric wire and each successive winding turn of said shield tape partially overlaps a winding turn of said shield tape just wound.

* * * * *